US010864488B2

(12) United States Patent
Taylor et al.

(10) Patent No.: US 10,864,488 B2
(45) Date of Patent: Dec. 15, 2020

(54) ANTI-SEGREGATION MIXER

(71) Applicant: HATCH PTY LTD, Brisbane (AU)

(72) Inventors: Wesley Adam Taylor, Warner (AU); Ross Jeffrey Haywood, Cashmere (AU)

(73) Assignee: HATCH PTY LTD, Brisbane (AU)

( * ) Notice: Subject to any disclaimer, the term of this patent is extended or adjusted under 35 U.S.C. 154(b) by 774 days.

(21) Appl. No.: 14/899,603

(22) PCT Filed: Jun. 20, 2014

(86) PCT No.: PCT/AU2014/000642

§ 371 (c)(1),
(2) Date: Dec. 18, 2015

(87) PCT Pub. No.: WO2014/201508

PCT Pub. Date: Dec. 24, 2014

(65) Prior Publication Data

US 2016/0136597 A1 May 19, 2016

(30) Foreign Application Priority Data

Jun. 20, 2013 (AU) ..... 2013902247

(51) Int. Cl.
*B01F 9/00* (2006.01)
*B01F 9/08* (2006.01)
(Continued)

(52) U.S. Cl.
CPC ..... *B01F 9/08* (2013.01); *B01F 9/0034* (2013.01); *F27B 7/14* (2013.01); *F27B 7/161* (2013.01);
(Continued)

(58) Field of Classification Search
CPC .. F27B 7/162; F27B 7/161; F27B 7/14; B01F 9/0034
See application file for complete search history.

(56) References Cited

U.S. PATENT DOCUMENTS 3,445,099 A * 5/1969 Olsen ..... F23M 5/06 110/246
3,836,612 A * 9/1974 Mann ..... B28B 5/12 264/30
(Continued)

FOREIGN PATENT DOCUMENTS

GB 820971 A 9/1959
GB 1396402 A 6/1975
(Continued)

OTHER PUBLICATIONS

International Search Report and Written Opinion of the ISA for PCT/AU2014/000642, ISA/AU, Woden ACT, dated Jul. 25, 2014.

*Primary Examiner* — Anshu Bhatia
(74) *Attorney, Agent, or Firm* — Harness, Dickey & Pierce, P.L.C.

(57) ABSTRACT

An anti-segregation mixer for a bed of material, the anti-segregation mixer comprising:
- an elongate and substantially cylindrical shell having an inner surface; and
- a plurality of independent lifting means provided within the shell,
- wherein the plurality of lifting means each comprise a vane with a leading end and a trailing end, and are arranged with respect to the cylindrical shell such that the vane is spaced apart from the inner surface and the entire lifting means may pass through the bed of material.

20 Claims, 8 Drawing Sheets

(51) Int. Cl.
*F27B 7/14* (2006.01)
*F27B 7/16* (2006.01)
*F27B 7/18* (2006.01)

(52) U.S. Cl.
CPC ..... *F27B 7/162* (2013.01); *F27B 7/18* (2013.01); *B01F 2009/0092* (2013.01)

(56) References Cited

U.S. PATENT DOCUMENTS

| | | | | | |
|---|---|---|---|---|---|
| 3,940,118 | A * | 2/1976 | Heinemann | B01J 8/10 | 366/228 |
| 5,975,752 | A * | 11/1999 | Doerksen | F27B 7/162 | 366/228 |
| 2006/0269887 | A1* | 11/2006 | Von Blucher | F27B 7/162 | 432/118 |
| 2010/0302898 | A1* | 12/2010 | Tolle | B01F 3/18 | 366/147 |

FOREIGN PATENT DOCUMENTS

| | | | |
|---|---|---|---|
| JP | 2008-105005 | A | 5/2008 |
| SU | 443070 | A1 | 9/1974 |
| WO | WO-1999/044000 | A1 | 9/1999 |

* cited by examiner

ANTI-SEGREGATION MIXER

CROSS-REFERENCE TO RELATED APPLICATIONS

This application is a 371 U.S. National Stage of International Application No. PCT/AU2014/000642, filed Jun. 20, 2014. This application claims the benefit of Australian Patent Application No. 2013902247, filed Jun. 20, 2013. The entire disclosures of the above applications are incorporated herein by reference.

A TECHNICAL FIELD

The present invention relates to an anti-segregation mixer. More particularly, it is intended that the present invention relates to an anti-segregation mixer for use in rotary kilns.

BACKGROUND ART

The following discussion of the background art is intended to facilitate an understanding of the present invention only. The discussion is not an acknowledgment or admission that any of the material referred to is or was part of the common general knowledge as at the priority date of the application.

Rotary kilns are well known in the art of the cement and other industries as a means to raise the temperature of material to a high temperature in a continuous process. Historically, rotary kilns comprise a slightly inclined rotating steel cylinder called the shell. The raw material is fed into the top end of the kiln forming a bed of material. The bed slowly tumbles down the kiln (due to the slope of the shell and its rotation) until it discharges from the lower end. The material is heated, generally directly by an internal flame generated by the burner. The shell is refractory lined to reduce the steel temperature to an acceptable level and for heat conservation. The steel shell is supported on large cast steel tires and support rollers. A wet feed may also be passed through the rotary kiln wherein part of the kiln performs a drying process.

Previous attempts to improve the efficiency of the rotary kiln have in included the use of a number of features being added to the inside of the rotary kilns. These have included the use of lifting means, chains, tumblers and trefoils. Such features act to disrupt the normal movement of the bed of the material within the rotary kiln in order to maintain adequate mixing and temperature distribution of the bed of material. Some features such as chains are primarily focused on increased heat transfer between the material bed and the kiln gases.

Despite these attempts, there remains a problem with segregation within the bed of material, whereby some particles, due to size and/or density, move to the centre of the bed and remain there. This results in poor heat transfer to the material held within this central zone of the bed of material, reducing the kiln efficiency.

The present invention seeks to overcome, or at least ameliorate, one or more of the deficiencies of the prior art mentioned above, or to provide the consumer with a useful or commercial choice.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness.

Throughout this specification, unless the context requires otherwise, the word "comprise" or variations such as "comprises" or "comprising", will be understood to imply the inclusion of a stated integer or group of integers but not the exclusion of any other integer or group of integers

SUMMARY OF INVENTION

In accordance with the present invention there is provided an anti-segregation mixer for a bed of material, the anti-segregation mixer comprising:

an elongate and substantially cylindrical shell having an inner surface; and a plurality of independent lifting means provided within the shell, wherein the plurality of lifting means each comprise a vane with a leading end and a trailing end, and are arranged with respect to the cylindrical shell such that the vane is spaced apart from the inner surface and the entire lifting means may pass through the bed of material.

Preferably, the entire lifting means will pass through an approximate centre of the bed of material.

Preferably, during operation of the anti-segregation mixer the leading end will pass through the bed of material before the trailing end.

Preferably, the lifting means are arranged whereby the distance between the leading end and the elongate cylindrical shell is smaller than the distance between the trailing end and the elongate shell.

Preferably, the lifting means are curved in shape. More preferably, the lifting means are non-uniformly curved along their length. Still preferably, the lifting means are shaped such that the radius of curvature of the lifting means increases towards the trailing end of the lifting means.

In a preferred form, the radius of curvature of the leading end is substantially smaller than the radius of curvature of the elongate shell. More preferably, the curvature of the leading end is internally tangent to a pitch circle at the leading end. Still preferably, the lifting means becomes substantially straight towards the trailing end. It will be appreciated that the angle in which the trailing end diverges from the tangent to the pitch circle diameter will depend on many factors, including the size of the anti-segregation mixer, the size of the lifting means and the material being processed.

In one form of the present invention, the mixer further comprises a series of separate rows of the plurality of lifting means that are spaced along the length of the elongate cylindrical shell.

Preferably, the width of each lifting means in a kiln axial direction is between 25% of, and 100% of, the inner diameter of the cylindrical shell.

Preferably, the length of each lifting means in a kiln circumferential direction is between 5% of, and 25% of, the inner diameter of the cylindrical shell.

In one form of the present invention, each of the lifting means are mounted on one or more posts extending radially from the cylindrical shell.

In a further form of the present invention, the lifting means are mounted on a mounting ring which runs concentrically within the kiln section such that it passes through the lifting means blades. Preferably, the mounting ring is hung by short chain sections or posts from the elongate cylindrical shell at various locations.

In a further form of the present invention, the mounting ring is supported by pivoting link rods extending from the elongate cylindrical shell at various locations.

In accordance with a further aspect of the present invention there is provided a rotary kiln comprising:

an elongate and substantially cylindrical shell having an inner surface; and a plurality of independent lifting means provided within the shell, wherein the plurality of lifting means each comprise a vane with a leading end and a trailing end, and are arranged with respect to the cylindrical shell such that the vane is spaced apart from the inner surface and the entire lifting means may pass through the bed of material.

Preferably, the entire lifting means will pass through an approximate centre of the bed of material.

Preferably, during operation of the anti-segregation mixer the leading end will pass through the bed of material before the trailing end.

Preferably, the lifting means are arranged whereby the distance between the leading end and the elongate cylindrical shell is smaller than the distance between the trailing end and the elongate shell.

Preferably, the lifting means are curved in shape. More preferably, the lifting means are non-uniformly curved along their length. Still preferably, the lifting means are shaped such that the radius of curvature of the lifting means increases towards the trailing end of the lifting means.

In a preferred form, the radius of curvature of the leading end is substantially smaller than the radius of curvature of the elongate shell. More preferably, the curvature of the leading end is internally tangent to a pitch circle at the leading end. Still preferably, the lifting means becomes substantially straight towards the trailing end. It will be appreciated that the angle in which the trailing end diverges from the tangent to the pitch circle will depend on many factors, including the size of the anti-segregation mixer, the size of the lifting means and the material being processed.

In one form of the present invention, the mixer further comprises a series of separate rows of the plurality of lifting means that are spaced along the length of the elongate cylindrical shell.

Preferably, the width of each lifting means in a kiln axial direction is between 25% of, and 100% of, the inner diameter of the cylindrical shell.

Preferably, the length of each lifting means in a kiln circumferential direction is between 5% of, and 25% of, the inner diameter of the cylindrical shell.

In one form of the present invention, each of the lifting means are mounted on one or more posts extending radially from the cylindrical shell.

In a further form of the present invention, the lifting means are mounted on a mounting ring which runs concentrically within the kiln section such that it passes through the lifting means blades. Preferably, the mounting ring is hung by short chain sections or posts from the elongate cylindrical shell at various locations.

In a further form of the present invention, the mounting ring is supported by pivoting link rods extending from the elongate cylindrical shell at various locations.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

In an attempt to overcome the above problems associated with bed mixing and heat transfer to the bed a number of internal kiln technologies have been implemented. The primary form of technology used are lifting means and tumblers.

Lifters

Metal lifting means are typically used for more aggressive bed mixing than refractory tumblers. They are basically a plurality of metal rods that extend radially from the shell of the kiln. The lifting means also act as heat exchange plates, transferring heat from the gas to the bed in a similar manner to the chains.

Figure 1:
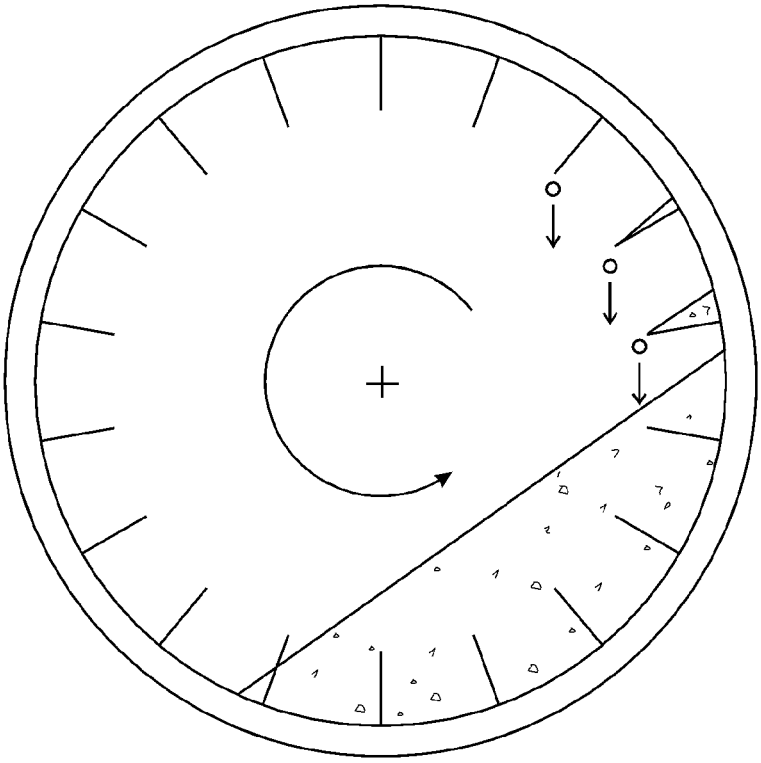
FIG. 1 shows prior art metal lifting means commonly used on nickel laterite kilns.

These types of lifting means only prevent segregation of the bed if the lifter height passes through the central zone of the rolling bed. This was identified by the Applicant using DEM (Discrete Element Analysis). It was seen that segregation was prevented in the 10% fill factor bed. However, when the bed fill reached 20% the central kidney region of the bed was above the height of the lifting means, and segregation still occurred. The DEM model also showed the lifting and dropping of the bed that occurs with this type of lifting means, as depicted in FIG. 1. This lifting and dropping causes significant dust generation. The dust generation in nickel laterite kilns with these lifting means can be up to 25% of the feed rate.

Tumblers

Figure 2:
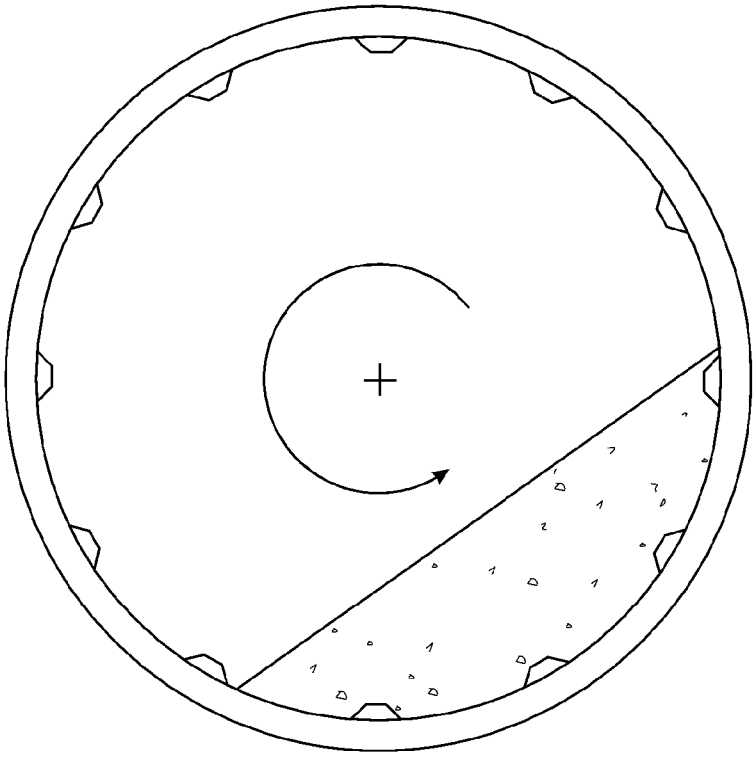
FIG. 2 shows prior art tumblers commonly used on nickel laterite kilns.

Tumblers are largely a lifter with a profile that reduces the lifting of the bed, and the subsequent dust generation. Refractory tumblers are often used to very gently stir the bed. They are installed in a hope they will mix the bed and prevent segregation, but DEM simulation by the Applicant has shown they have minimal effect in this regard. A rotary kiln fitted with tumblers is shown in FIG. 2.

Figure 3:
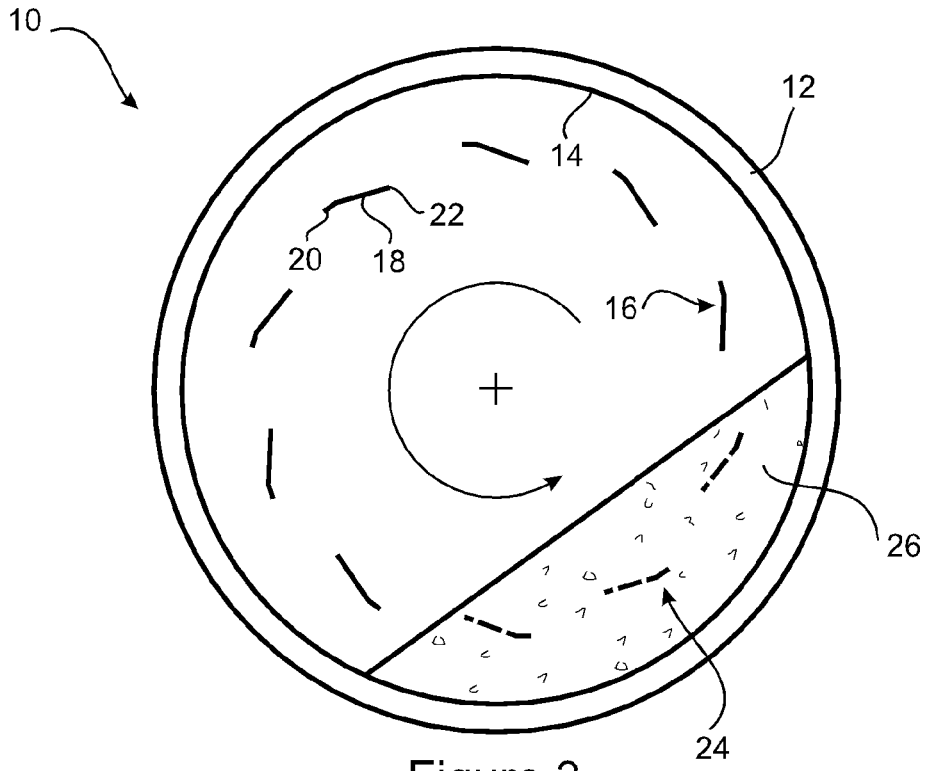
FIG. 3 shows a cross section of the mixer of the present invention mixing a bed of material.
Figure 4:
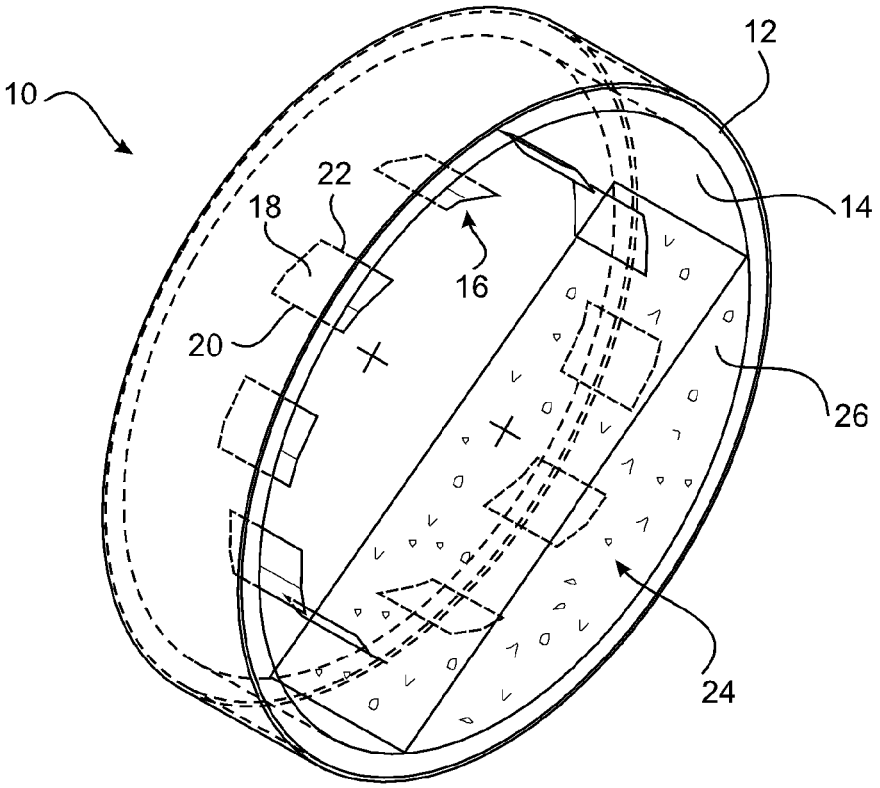
FIG. 4 is an upper perspective view of a portion the mixer of FIG. 3.
Figure 5:
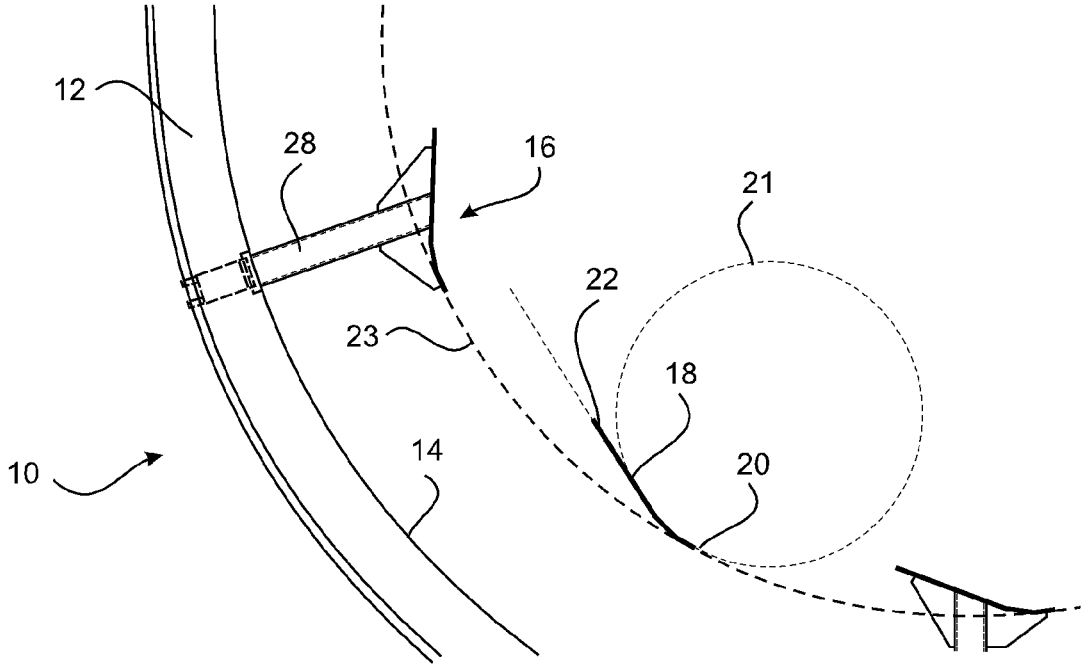
FIG. 5 is a cross sectional view of the mixer of FIG. 3, detailing the lifting means angle.

In FIG. 3 and FIG. 4, there is shown a mixer 10 in accordance with the present invention. The mixer 10 comprises an elongate cylindrical shell 12 having an inner surface 14. A plurality of lifting means 16 are provided within the elongate cylindrical shell 12. Each lifting means 16 comprises a vane 18, having a leading end 20, with a radius of curvature 21, and a trailing end 22. The plurality of lifting means 16 are arranged substantially concentrically about and within the shell 12. The plurality of lifting means 16 are further positioned within the shell 12 relative to the inner surface 14 such that the vane 18 is spaced apart from the inner surface 14 and the entire lifting means 16 may pass through the center 24 of the bed of material 26. The outermost limit of the lifting means 16 defines a pitch circle 23, which is positioned to be concentric to the elongate shell 12, with a radius defined by the distance between the center of elongate shell and the position of the leading end 20, as is best seen in FIG. 5.

When in use the leading end 20 passes through the bed of material 26 before the trailing end 22.

The lifting means 16 are arranged so that distance between the leading end 20 and the inner surface 14 is smaller than the distance between the trailing end 22 and the inner surface 14.

The lifting means 16 are curved in shape, such that the curve is non-uniform along their length. The lifting means 16 are shaped whereby the radius of curvature of the lifting means 16 increases towards the tailing end 22 of the lifting means 16. This is best seen in FIG. 5 wherein the radius of curvature 21 of the lifting means 16 at the leading end 20 is substantially smaller than the radius of curvature of the elongate shell 12. The curvature of the leading end 20 is internally tangent to the pitch circle 23 at the leading end 20. The lifting means 16 becomes substantially straight towards the trailing end 22.

The width of each lifting means 16 in a kiln axial direction is between 25% of, and 100% of, the inner diameter of the cylindrical shell 12. The length of each lifting means 16 in a kiln circumferential direction is between 5% of, and 25% of, the inner diameter of the cylindrical shell 12.

Figure 6:
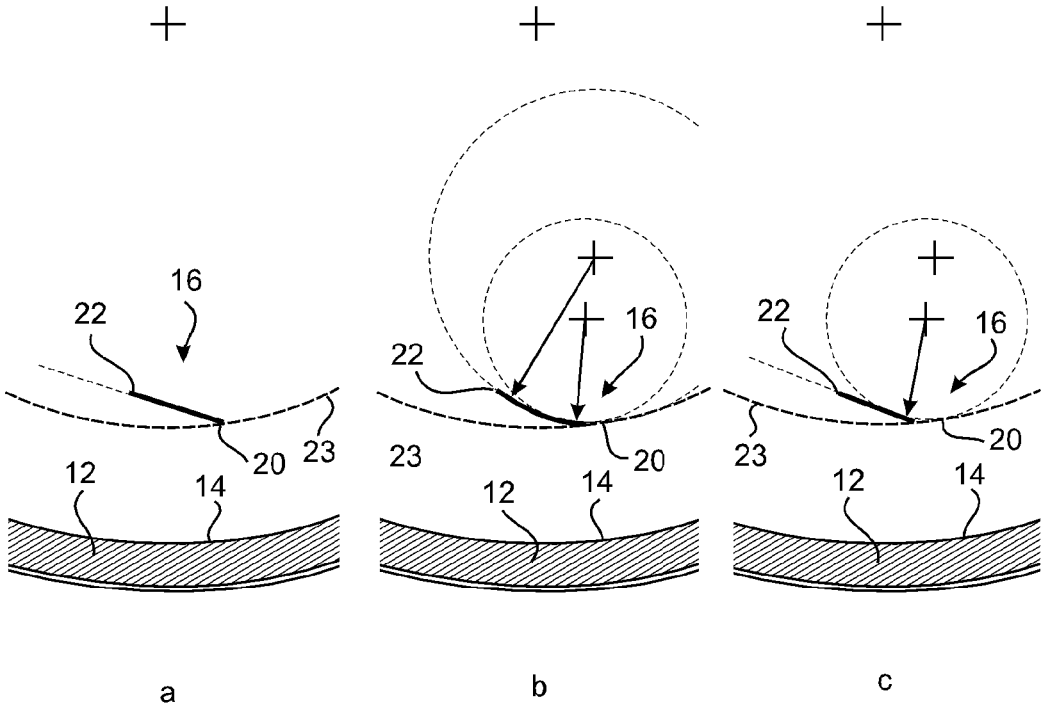
FIGS. 6*a-c* show a cross sectional view of the various lifting means shapes that may be utilised in the kiln of the present invention

As seen in FIGS. 6*a*-*c*, the lifting means 16 of the present may be provided in various forms. This includes a substantially straight lifting means 16 (FIG. 6*a*). In a further embodiment, the lifting means 16 may be curved along its entire length, where the radius of curvature increases along the length of the lifting means 16 (FIG. 6*b*). In a still further embodiment, the lifting means 16 becomes substantially straight toward the trailing end (FIG. 6*c*). It will be appreciated that the shape of the lifting means 16 and the angle at which the trailing end 22 diverges from tangent to the leading end 20 pitch circle diameter 21 will depend on many factors, including the size of the anti-segregation mixer, the size of the lifting means 16 and the material being processed.

The mixer 10 comprises a series of separate rows of the plurality of lifting means 16 that are spaced along the length of the elongate cylindrical shell 12. The row spacing should preferably range from forming continuous rows of lifting means along the length of the elongate cylindrical shell, to a spacing of not more than one cylindrical shell diameter in order to prevent re-segregation of the bed.

Figure 7:
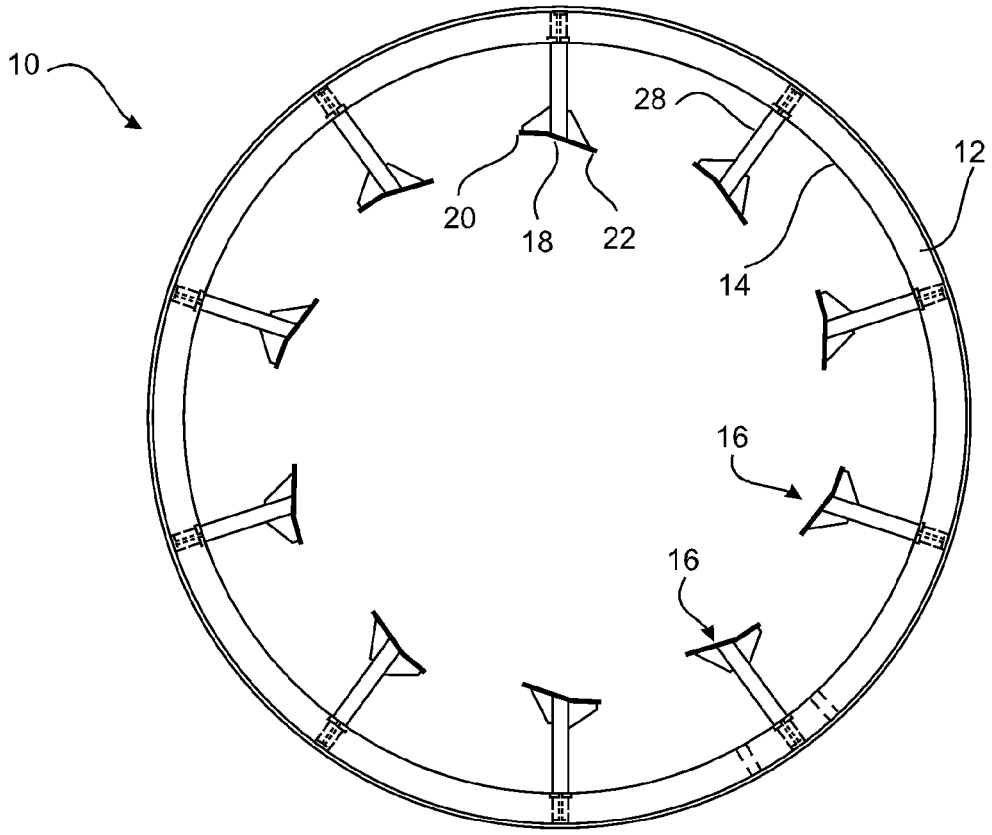
FIG. 7 is a cross sectional view of the mixer of FIG. 3, utilising single posts to mount the lifting means.
Figure 8:
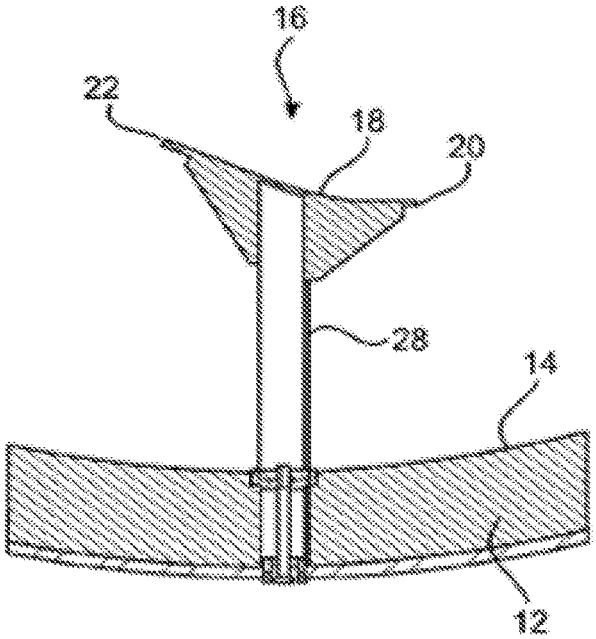
FIG. 8 is a cross sectional view of the mixer of FIG. 3, detailing the single posts of FIG. 7.

In one embodiment of the present invention, each of the lifting means 16 are mounted on a single post 28 extending radially from the cylindrical shell 12 as shown in FIG. 7 and FIG. 8.

Figure 9:
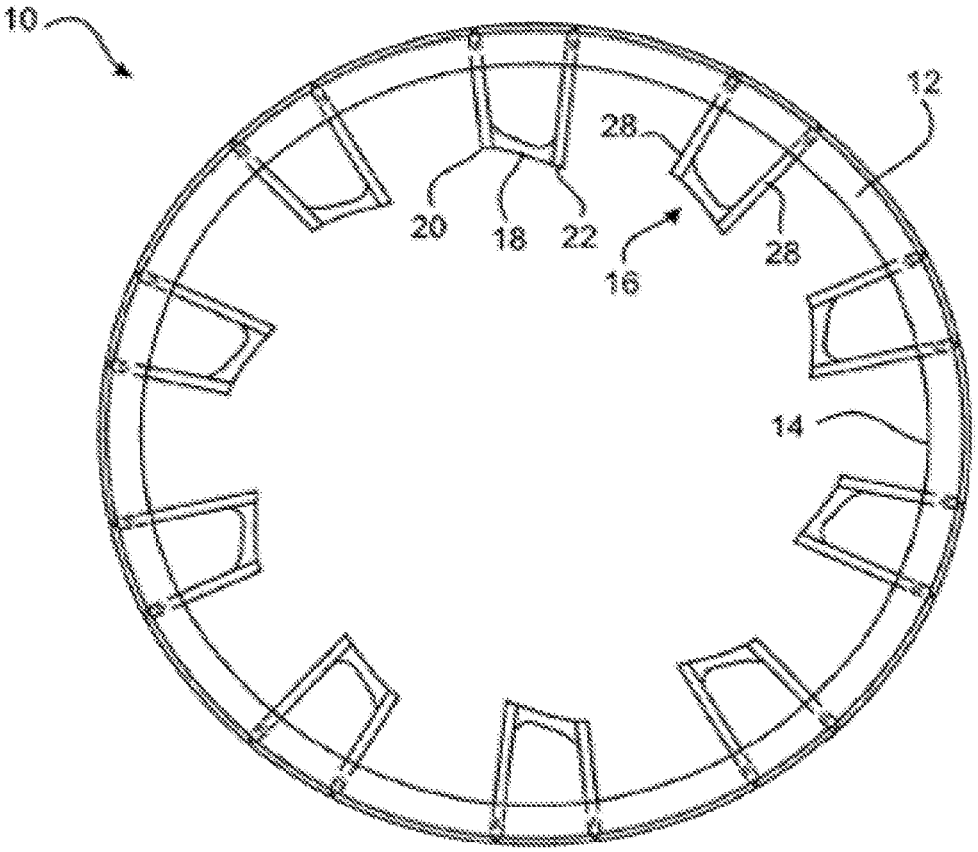
FIG. 9 is a cross sectional view of the mixer of FIG. 3, utilising dual posts to mount the lifting means.
Figure 10:
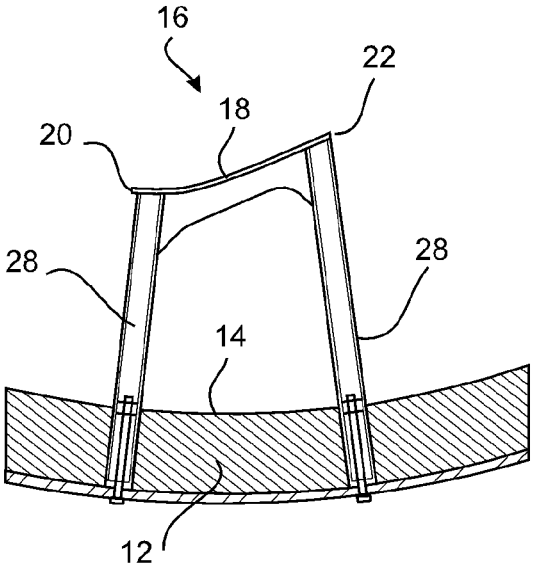
FIG. 10 is a cross sectional view of the mixer of FIG. 3, detailing the dual posts of FIG. 9.

In one embodiment of the present invention, each of the lifting means 16 are mounted on two or more posts 28 extending radially from the cylindrical shell 12 as shown in FIG. 9 and FIG. 10.

Figure 11:
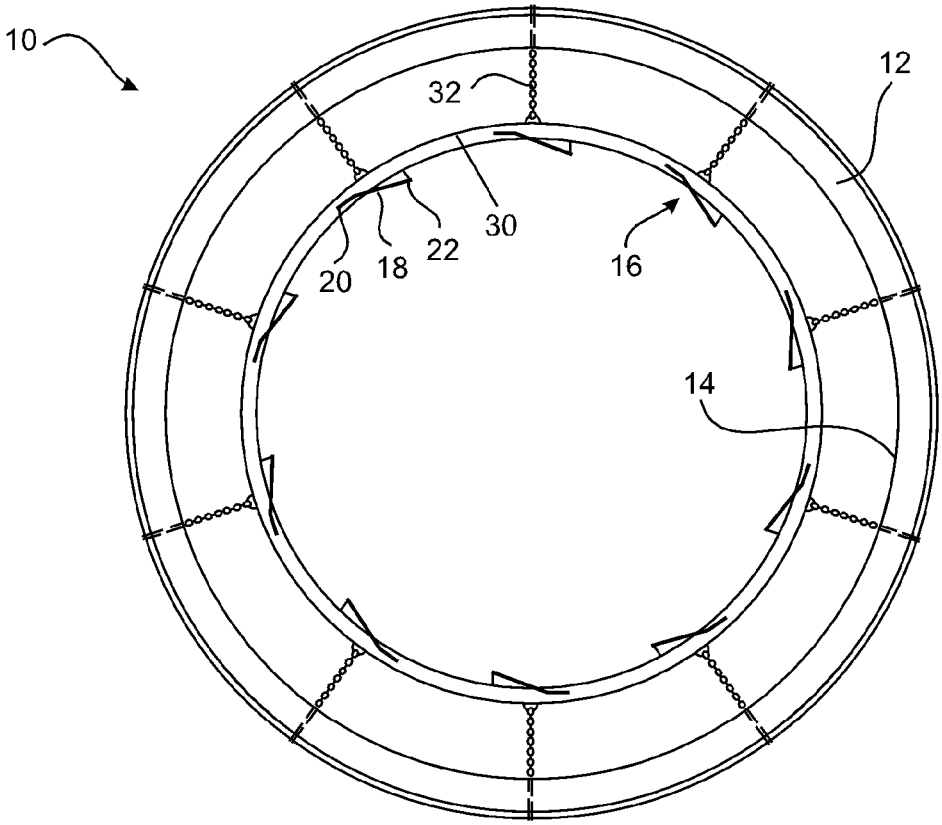
FIG. 11 is a cross sectional view of the mixer of FIG. 3, utilising a mounting ring hung by short chains lengths to mount the lifting means.
Figure 12:
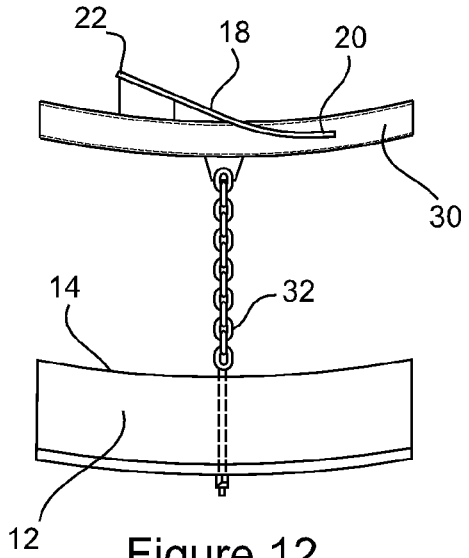
FIG. 12 is a cross sectional view of the mixer of FIG. 3, detailing the chain lengths of FIG. 11.

In a further embodiment of the present invention, as shown in FIGS. 11 and 12 each of the lifting means 16 are mounted on a mounting ring 30 which is arranged substantially concentrically within the elongate cylindrical shell 12 in-line with the blade of the lifting means 16. The mounting ring 30 is hung by short chain sections 32 from the elongate cylindrical shell 12 at various locations.

Figure 13:
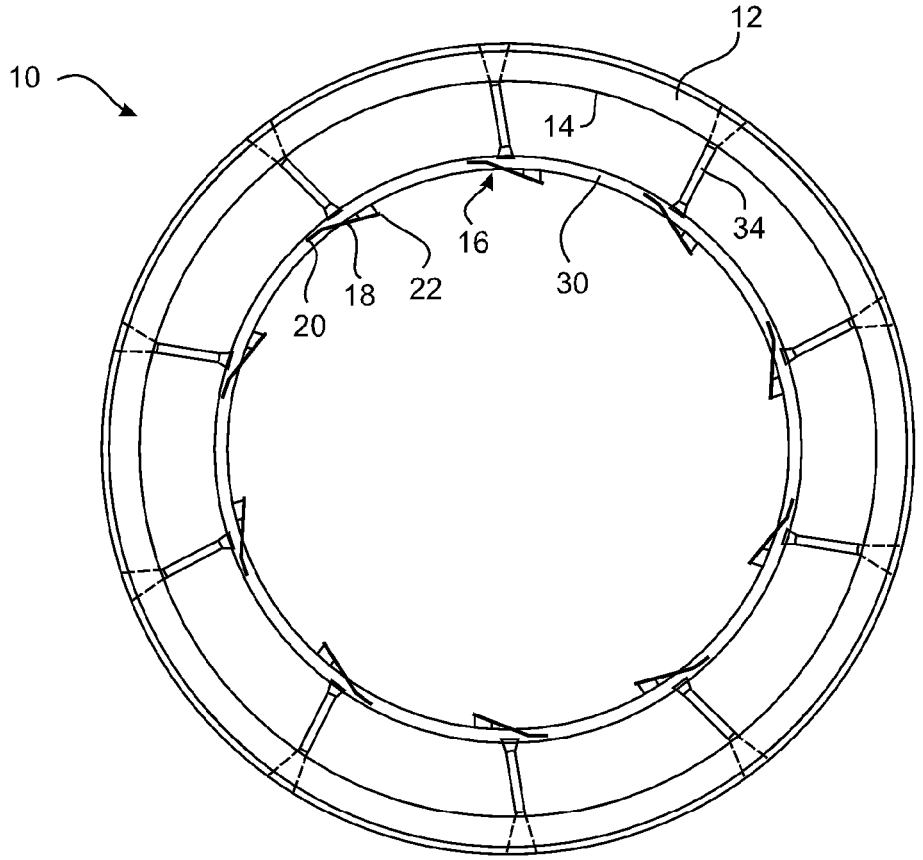
FIG. 13 is a cross sectional view of the mixer of FIG. 3, utilising a mounting ring hung by pivot link rods to mount the lifting means.
Figure 14:
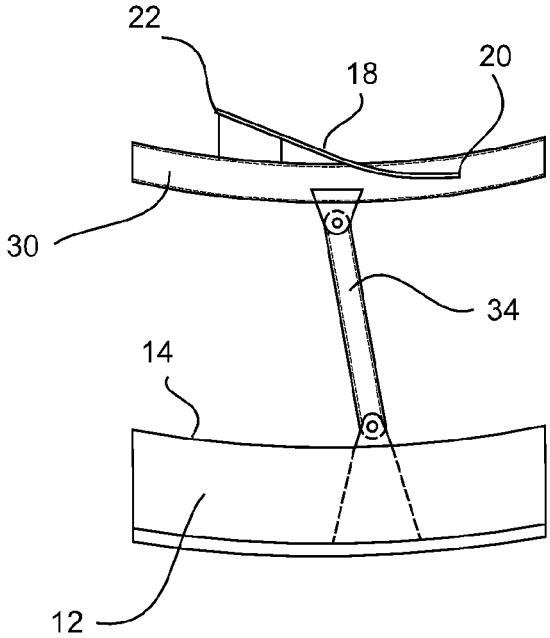
FIG. 14 is a cross sectional view of the mixer of FIG. 3, detailing the pivot link rods of FIG. 13.

In a further embodiment of the present invention, each of the lifting means 16 are mounted on a mounting ring 30 (FIG. 13) which runs concentrically around the inside of the elongate cylindrical shell 12 in-line with the lifting means blades 16. The mounting ring is held in position by pivoting rods 34 from the elongate cylindrical shell 12 at various locations. The pivoting rods 34 allow for thermal expansion of the mounting ring 30.

As can be seen from the above description, the anti-segregation mixer of the present invention overcomes substantially the problems associated with the mixers previously utilised in prior art rotary kilns through the provision of the plurality of lifting means about the cylindrical shell in a manner such that the entire lifting means passes through the bed of material. In this manner the efficiency of the mixer, for example a kiln, is increased by improving heat transfer to the bed of material.

Modifications and variations such as would be apparent to the skilled addressee are considered to fall within the scope of the present invention.

The invention claimed is:

1. An anti-segregation mixer for a bed of material, the anti-segregation mixer comprising:

an elongate and substantially cylindrical shell having an inner surface; and a plurality of independent lifting means provided within the shell, wherein the plurality of lifting means each comprise a vane with a leading end and a trailing end, wherein the plurality of lifting means are arranged with respect to the cylindrical shell such that the vane is spaced apart from the inner surface, and when the cylindrical shell comprises a lining, the lining is adjacent to the inner surface, wherein the plurality of lifting means are substantially concentric with the cylindrical shell, and wherein the entire lifting means passes through the bed of material.

2. The anti-segregation mixer according to claim 1, wherein the entire lifting means will pass through an approximate center of the bed of material.

3. The anti-segregation mixer according to claim 1, wherein during operation of the anti-segregation mixer the leading end will pass through the bed of material before the trailing end.

4. The anti-segregation mixer according to claim 1, wherein the lifting means are arranged whereby a distance between the leading end and the elongate cylindrical shell is smaller than a distance between the trailing end and the elongate shell.

5. The anti-segregation mixer according to claim 1, wherein the lifting means are curved in shape.

6. The anti-segregation mixer according to claim 5, wherein the lifting means are non-uniformly curved along their length.

7. The anti-segregation mixer according to claim 5, wherein the lifting means are shaped such that a radius of curvature of the lifting means increases towards the trailing end of the lifting means.

8. The anti-segregation mixer according to claim 5, wherein a radius of curvature of the leading end is substantially smaller than a radius of curvature of the elongate shell.

9. The anti-segregation mixer according to claim 8, wherein the curvature of the leading end is internally tangent to a pitch circle at the leading end.

10. The anti-segregation mixer according to claim 5, wherein the lifting means becomes substantially straight towards the trailing end.

11. The anti-segregation mixer according to claim 1, wherein the mixer further comprises a series of separate rows of the plurality of lifting means that are spaced along a length of the elongate cylindrical shell.

12. The anti-segregation mixer according to claim 1, wherein a width of each lifting means in a kiln axial direction is between 25% of, and 100% of, the inner diameter of the cylindrical shell.

13. The anti-segregation mixer according to claim 1, wherein a length of each lifting means in a kiln circumferential direction is between 5% of, and 25% of, the inner diameter of the cylindrical shell.

14. The anti-segregation mixer according to claim 1, wherein each of the lifting means are mounted on one or more posts extending radially from the cylindrical shell.

15. The anti-segregation mixer according to claim 1, wherein the lifting means are mounted on a mounting ring which runs concentrically within a kiln section such that it passes through the lifting means.

16. The anti-segregation mixer according to claim 15, wherein the mounting ring is hung by short chain sections or posts from the elongate cylindrical shell at various locations.

17. The anti-segregation mixer according to claim 15, wherein the mounting ring is supported by pivoting link rods extending from the elongate cylindrical shell at various locations.

18. A rotary kiln comprising: the anti-segregation mixer as described in claim 1.

19. The anti-segregation mixer according to claim 1, wherein the lining is a refractory lining.

20. An anti-segregation mixer for a bed of material, the anti-segregation mixer comprising:

an elongate and substantially cylindrical shell having an inner surface; and a plurality of independent lifting means disposed within and substantially concentric with the cylindrical shell, wherein the plurality of lifting means each comprise a vane with a leading end and a trailing end and the lifting means are arranged whereby a distance between the leading end and the elongate cylindrical shell is smaller than a distance between the trailing end and the elongate shell; and wherein the plurality of lifting means are arranged with respect to the cylindrical shell such that the vane is spaced apart from the inner surface and in each instance the entire lifting means passes through the bed of material.

* * * * *